United States Patent [19]

Cygler et al.

[11] 4,224,977

[45] Sep. 30, 1980

[54] MOLD ASSEMBLY AND METHOD FOR CONTINUOUS CASTING

[75] Inventors: Michael Cygler, Colonia; Joseph L. Cuomo, Oakland; Michael Poran, Westwood, all of N.J.

[73] Assignee: Concast Incorporated, Montvale, N.J.

[21] Appl. No.: 9,845

[22] Filed: Feb. 6, 1979

[51] Int. Cl.[3] ..... B22D 11/04; B22D 11/00

[52] U.S. Cl. ..... 164/82; 164/443; 164/416

[58] Field of Search ..... 164/82, 86, 89, 418, 164/420, 443, 416, 83

[56] References Cited

U.S. PATENT DOCUMENTS

| | | | |
|---|---|---|---|
| 3,273,208 | 9/1966 | Greenberger | 164/420 |
| 3,717,197 | 2/1973 | Strock et al. | 164/420 |
| 3,730,255 | 5/1973 | Bollig et al. | 164/416 |
| 3,773,103 | 11/1973 | Burkhardt et al. | 164/420 |
| 3,780,789 | 12/1973 | Unger | 164/420 |
| 4,023,612 | 5/1977 | Jackson | 164/418 X |

FOREIGN PATENT DOCUMENTS

| | | | |
|---|---|---|---|
| 891444 | 9/1953 | Fed. Rep. of Germany | 164/420 |
| 46-39224 | 11/1971 | Japan | 164/444 |

*Primary Examiner*—Robert D. Baldwin
*Assistant Examiner*—K. Y. Lin
*Attorney, Agent, or Firm*—Tobias Lewenstein

[57] ABSTRACT

A mold assembly for continuous casting has a plurality of open-ended molds. The mold assembly further has a cooling member which is common to all of the molds and cooperates with each mold to define one or more cooling passages therewith. The cooling member, which is provided with one or more pairs of coolant inlet and outlet bores, is in the form of a cooling jacket or in the form of a back-up plate depending upon whether the molds are tube molds or plate molds. The mold assembly is rotatably mounted on a mold table having a casting location at which a mold is positioned during a casting operation. A coolant supply and coolant discharge conduit are arranged in the mold table adjacent the casting location. In operation, one of the molds of the assembly is positioned at the casting location with the remaining molds being in standby positions. At least one pair of the coolant inlet and outlet bores in the cooling member is aligned with the coolant supply and discharge conduits in the mold table. Molten metal is introduced into the mold to form a continuously cast strand. When the mold is to be changed, the introduction of molten metal into the mold is terminated. The trailing end of the strand is withdrawn from the mold, the supply of coolant to the mold is discontinued, and the mold assembly is rotated to bring another mold into the casting position. In this manner, substitution of one mold for another may be accomplished rapidly and without removing the supply vessel for the molten metal.

20 Claims, 4 Drawing Figures

MOLD ASSEMBLY AND METHOD FOR CONTINUOUS CASTING

FIELD OF THE INVENTION

The invention relates generally to the continuous casting of metals, especially steel.

More particularly, the invention relates to a mold assembly and method for the continuous casting of metals.

BACKGROUND OF THE INVENTION

A conventional type of apparatus for the continuous casting of metals includes a cooled, generally vertical mold into which molten metal is continuously introduced from a suitable teeming vessel, e.g. a tundish. The molten metal adjacent the cooled walls of the mold solidifies thereby forming a shell which contains a molten core. The shell and its molten core are continuously withdrawn from the mold via a suitable withdrawal mechanism thus generating a long strand which is guided along a path curving towards the horizontal. Outside of the mold, the strand is subjected to the direct action of a coolant so that the molten core progressively solidifies as the strand moves along the path. After complete solidification, the strand is cut into sections which may be stored on a cooling bed or fed directly into a mill for further processing.

The mold forms part of a mold assembly which is supported on a mold table. The design of the mold assembly varies depending upon the cross-sectional area of the strand being cast but is invariable in that only a single mold is incorporated in the mold assembly.

For strands of relatively small cross-sectional area, the mold is in the form of a thermally conductive tube which is normally composed of copper. The mold assembly includes a cooling jacket which surrounds the mold circumferentially. The ends of the cooling jacket are closed by means of plates provided with openings which respectively register with the inlet and outlet openings of the mold. The mold is supported by the cooling jacket and the end plates of the cooling jacket are removable so as to permit the mold to be interchanged.

The cooling jacket has an inlet and an outlet for coolant and a baffle is arranged between the inner wall of the cooling jacket and the outer wall of the mold to direct the flow of coolant within the cooling jacket. The baffle is provided with a horizontal, annular flange on the outer surface thereof and this flange faces another horizontal flange provided on the inner surface of the cooling jacket. A seal is arranged between the two flanges. The coolant inlet is located below the flanges whereas the coolant outlet is located above the flanges. The flanges divert the coolant entering the cooling jacket around the lower end of the baffle to the interior thereof where the coolant travels upwardly in contact with the mold and around the upper end of the baffle to the coolant outlet.

For strands of relatively large cross-sectional area, the mold is made up of individual, thermally conductive plates which are normally composed of copper. The mold assembly includes back-up plates which are usually made of steel and the number of back-up plates equals the number of copper plates. One copper plate is mounted on each back-up plate. The individual sets consisting of back-up plate and copper plate are held together in the desired configuration by means of bolts.

The faces of the copper plates which abut the back-up plates are formed with channels which are intended for the circulation of coolant. The back-up plates have inlet and outlet conduits which open to the channels and coolant enters and leaves the channels in the copper plates via the back-up plates.

The mold is subject to wear due to the abrasive effect which arises as the strand moves through the mold. The abrasive effect of the strand results in marks on the inner surface of the mold which, in turn, affect the quality of the strand surface. When the marks on the inner surface of the mold become sufficiently pronounced, it is necessary to change the mold. It also becomes necessary to change the mold when a change in the cross-sectional configuration and/or dimensions of the strand is desired. Furthermore, if the mold is tapered, a mold change may be required when the metal being cast is replaced by one having different shrinkage characteristics.

In order to change the mold, the entire mold assembly must be detached from the mold table and removed from the casting apparatus. A new mold assembly is then inserted in the apparatus. This operation is cumbersome and time-consuming since the fasteners which secure the original mold assembly on the mold table must be removed and a crane or other lifting mechanism must be brought into position to lift the mold assembly and transport it from the vicinity of the mold table. The steps required to remove the original mold assembly from the casting apparatus must thereafter be repeated in reverse for the new mold assembly.

Another problem involved in changing a mold resides in that this cannot be accomplished while the teeming vessel which admits the molten metal into the mold remains in position. This poses a particular disadvantage in multistrand continuous casting installations where a single teeming vessel admits molten metal into a plurality of molds simultaneously. Should one of the molds become defective during a cast, it is necessary either to discontinue the flow of molten metal into the defective mold for the duration of the cast or to abort the entire cast in order to permit replacement of the defective mold. In the former case, the production rate is decreased and, in addition, there arises the possibility that a portion of the heat being cast may have to be discarded due to the fact that the reduced casting rate may not suffice to permit casting of the entire heat before solidification. In the latter case, the portion of the heat remaining at the time a mold becomes defective has either to be discarded or cast into conventional ingot molds which have well-known disadvantages.

In order to reduce the time which is required to change a mold, it has been proposed to mount a pair of mold assemblies on a turntable. The turntable is so arranged that one of the mold assemblies is in the casting position while the other of the mold assemblies is in a preparation position. When the mold in the casting position must be replaced, the turntable is rotated so that the mold assembly in the preparation position is brought into the casting position while the mold assembly originally in the casting position is brought into the preparation position. The mold assembly now in the preparation position may be replaced with a fresh mold assembly while casting proceeds with the mold assembly which has been rotated into the casting position.

A related proposal contemplates a pair of mold assemblies which are displaceable between a casting position and a preparation position along a linear path.

While the above proposals do reduce the time required to change a mold, there is the disadvantage that a relatively large amount of space is required. These proposals thus cannot be applied where space is limited and are also not well-suited for multistrand installations since the application thereof to each mold of such an installation would result in an unacceptable increase in size of the installation. Furthermore, casting apparatus utilizing the above proposals, as well as earlier casting apparatus, require that a substantial number of complete mold assemblies be kept on hand at all times to prevent interruptions of undue length in casting. This is especially true for casting apparatus which are designed to cast strands of various cross-sections.

OBJECTS OF THE INVENTION

An object of the invention is to provide a mold assembly and a method which make it possible to rapidly and simply substitute one mold for another in a reduced amount of space.

Another object of the invention is to provide a mold assembly and a method which make it possible to substitute one mold for another during a casting operation without moving the teeming vessel which supplies the molten metal for the molds.

An additional object of the invention is to provide a mold assembly and a method which permit the number of spare mold assemblies to be reduced.

SUMMARY OF THE INVENTION

The preceding objects, as well as others which will become apparent, are achieved by the invention.

The invention proposes a mold assembly which, in contrast to conventional mold assemblies, has a plurality of molds. The mold assembly further has a cooling member which is common to all of the molds and which cooperates with each of the latter to define a cooling passage therewith. The molds are movable to and from a common casting position while cooperating with the cooling member to define the respective cooling passages.

Since the mold assembly of the invention has a plurality of molds which are movable into and out of a common casting position and which, in addition, share a common cooling member, the novel mold assembly requires less space than heretofore for effecting a rapid and simple substitution of one mold for another. Among other things, this makes the mold assembly of the invention more adaptable to multistrand installations than prior quick-change mold assemblies. Furthermore, the substitution of one mold for another when using the novel mold assembly may be carried out without removing the teeming vessel. Moreover, since the molds may have different sizes and/or configurations, a change in the size and/or shape of a continuously cast strand may be effected without interrupting the casting operation for an extended period of time. Similiarly, since the molds may have different tapers, a change in the material being cast to one having different shrinkage characteristics does not require an extended shutdown. The number of spare mold assemblies required for a continuous casting installation may also be reduced in accordance with the invention since the mold assembly of the invention has more than one mold. In effect, the novel mold assembly may serve as an original and one or more spares.

According to one embodiment of the invention, the molds are in the form of tubes. The common cooling member here comprises a cooling jacket which surrounds the molds.

According to another embodiment of the invention, the molds are formed from individual, thermally conductive plates. The common cooling member here includes a back-up plate which cooperates with a thermally conductive plate of each mold to define respective cooling passages.

A method in accordance with the invention involves substituting one mold for another while continuing to define cooling passages by cooperation between the molds and the common cooling member.

DESCRIPTION OF THE PREFERRED EMBODIMENTS

Figure 1:
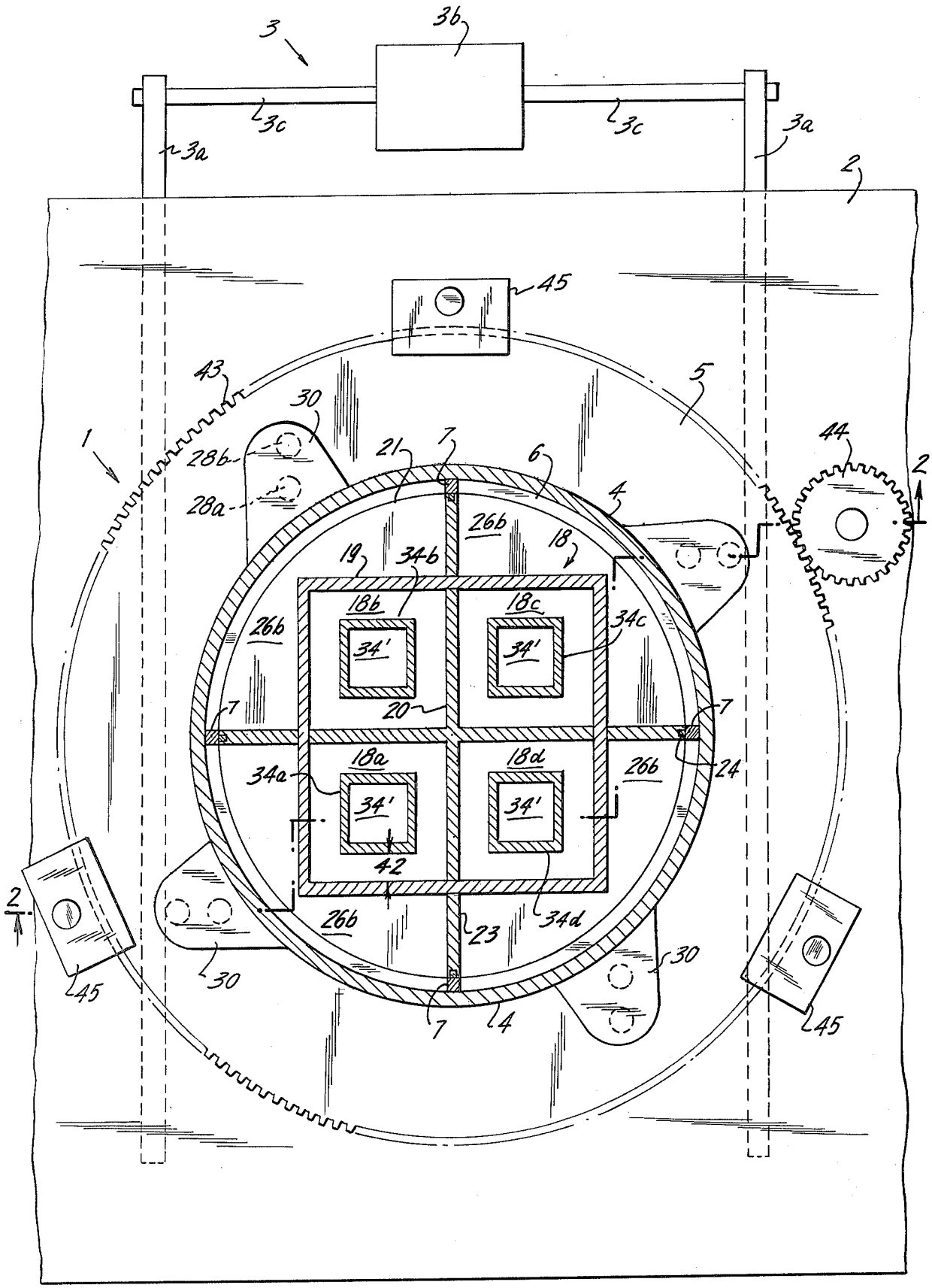
FIG. 1 is a horizontal sectional view of one embodiment of a mold assembly according to the invention.
Figure 2:
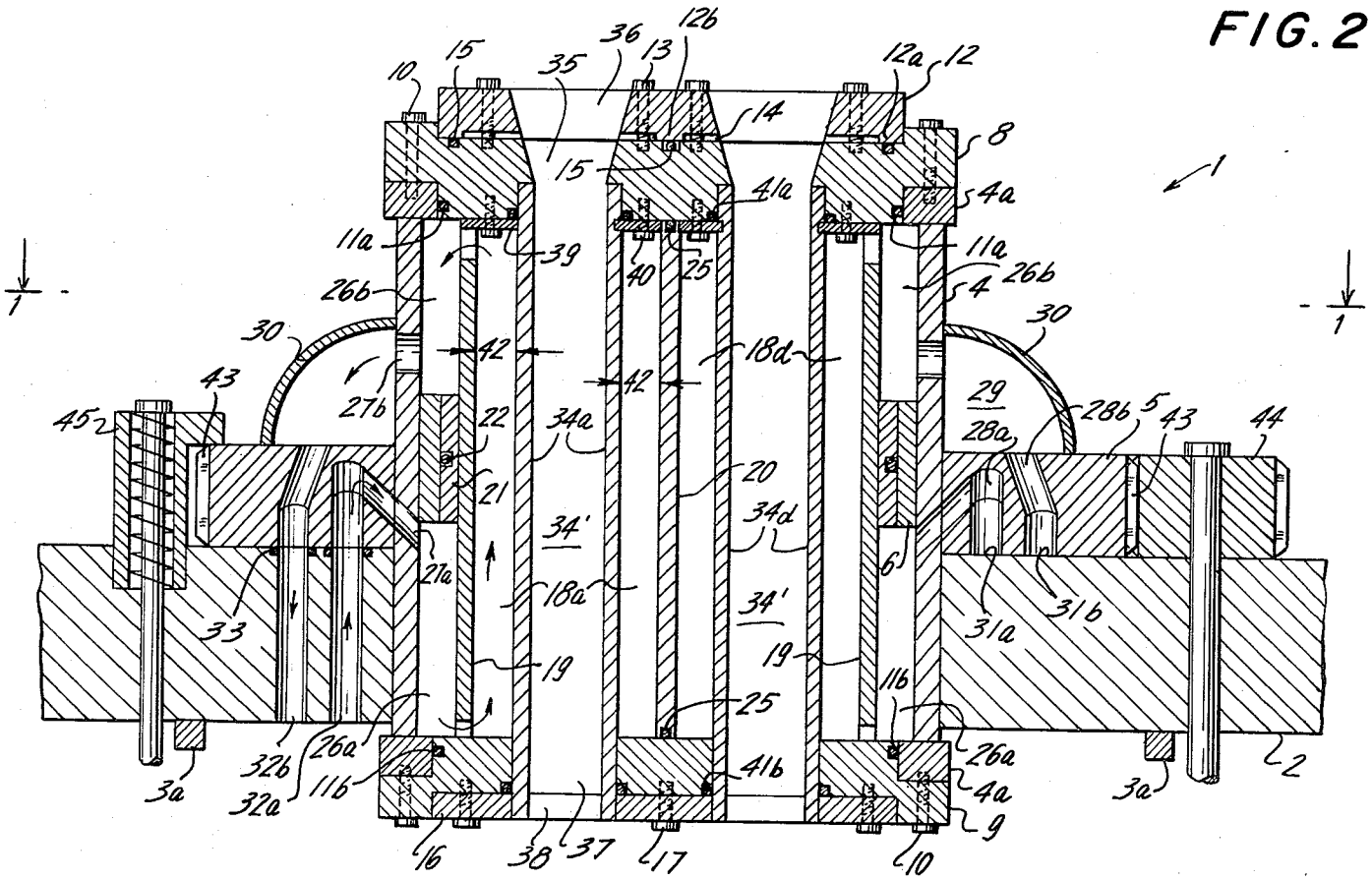
FIG. 2 is a vertical sectional view of the mold assembly of FIG. 1 as seen in the direction of the arrows 2—2.

With reference to FIGS. 1 and 2, a mold assembly 1 according to the invention rests on a mold table 2. The mold table 2 is mounted for reciprocation on a conventional oscillator 3. The latter includes a pair of reciprocating arms 3*a* which are driven by a motor 3*b* via linkages 3*c*.

The mold assembly 1 is here assumed to be arranged in an installation for the continuous casting of steel operating with molds having a generally vertical orientation. Since installations for the continuous casting of steel are well-known, only those details necessary for an understanding of the invention have been illustrated in the drawing.

The mold assembly 1 comprises a cooling jacket having an upright, circumferential wall 4 of cylindrical configuration provided with expanded ends 4*a*. An annular flange 5 encircles the wall 4 and supports the mold assembly 1 on the mold table 2. Another annular flange 6 is provided on the inner surface of the wall 4 and projects radially inwardly from this inner surface to at least the same depth as the expanded ends 4*a* of the wall 4. In addition, four sets of ribs are mounted on the inner surface of the wall 4 and are uniformly distributed about the circumference thereof. Each set includes a pair of ribs 7, which extend in longitudinal direction of the wall 4 and are aligned in this direction. One of the ribs 7 of each pair is located above the flange 6 whereas the other is located below the flange 6. The ribs 7 extend from the flange 6 to the expanded ends 4*a* of the wall 4, and the inner surfaces of the ribs 7 are flush with that of the flange 6.

End walls 8 and 9 are arranged at opposite ends of the circumferential wall 4 and are releasably secured to the latter via fasteners such as bolts 10. An annular seal 11*a* is situated between the end wall 8 and the adjacent expanded end 4*a* of the circumferential wall 4 whereas an annular seal 11*b*is situated between the end wall 9 and the expanded end 4*a* adjacent thereto. The seals 11*a* and 11*b* are seated in annular grooves provided in the end walls 8 and 9.

A guide 12 for a non-illustrated mold cover is arranged above the upper end wall 8. The guide 12, which is circular, is releasably secured to the end wall 8 by means of suitable fasteners such as bolts 13. On the side thereof facing the end wall 8, the guide 12 is provided with an annular projection 12*a* extending along its periphery as well as a pair of mutually perpendicular diametral projections 12*b* of which only one is shown. In this manner, the side of the guide 12 facing the upper end wall 8 is divided into four segments. The projections 12*a* and 12*b* rest on the end wall 8 so that a gap 14 is defined between the guide 12 and the end wall 8 within each of the segments. The projections 12*a* and 12*b* overlie matching grooves in the end wall 8 which accommodate seals 15.

A circular keeper plate 16 is provided below the lower end plate 9. The keeper plate 16 is releasably secured to the end plate 9 via suitable fasteners such as bolts 17.

Figure 3:
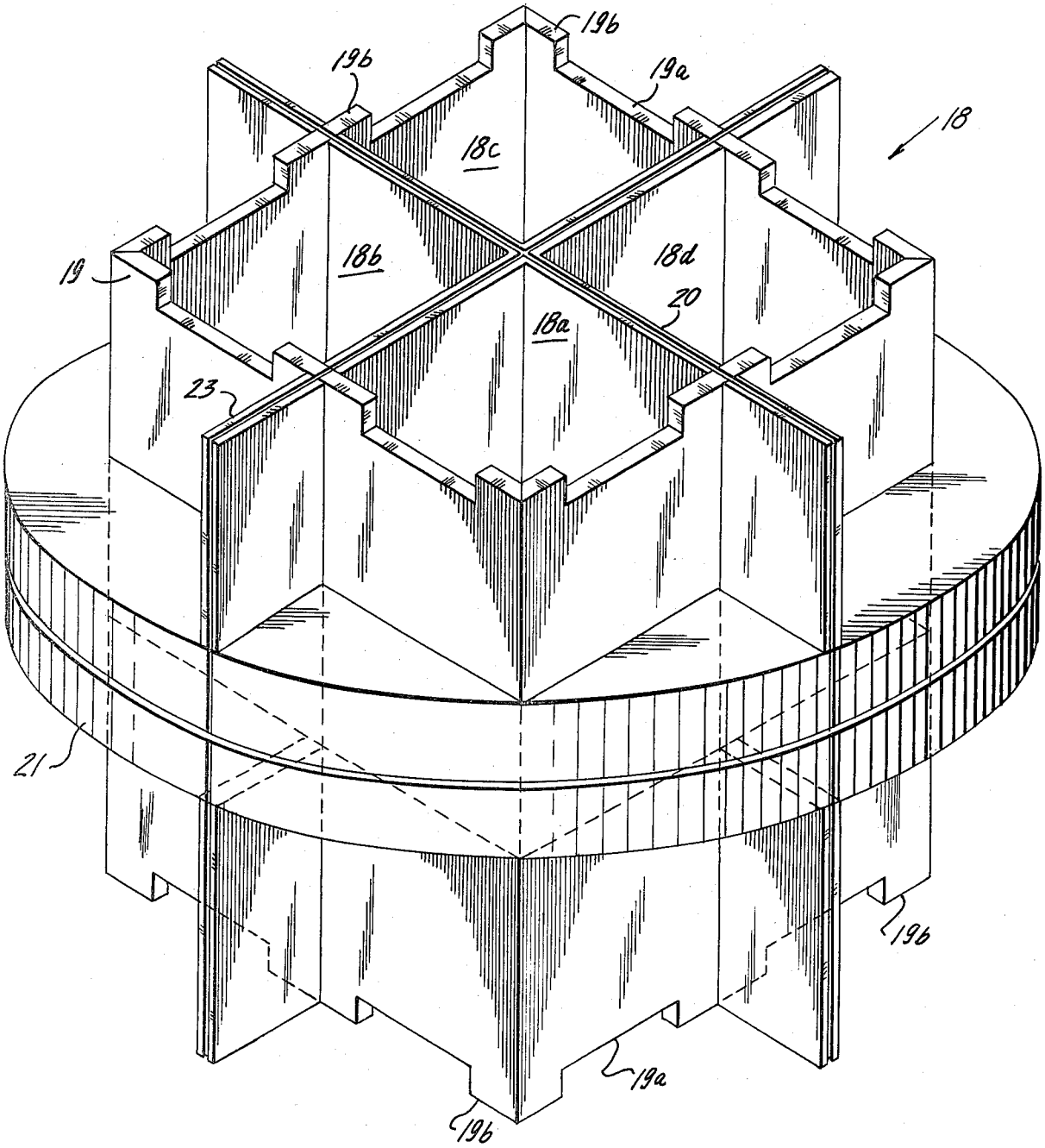
FIG. 3 is a perspective view of a baffle arrangement for use in the mold assembly of FIGS. 1 and 2.

A baffle 18 for directing the flow of coolant through the cooling jacket is arranged inside the latter. As best seen in FIG. 3, the baffle 18 comprises a peripheral wall 19 as well as a cruciform-like member 20 arranged within the space enclosed by the peripheral wall 19. The cruciform-like member 20 divides the space within the peripheral wall 19 into four generally vertical compartments 18*a*, 18*b*, 18*c*, and 18*d*.

Although the peripheral wall 19 is shown as having a square outline, it will be understood that the peripheral wall 19 may have other appropriate outlines, e.g. rectangular or circular.

The upper and lower edges of the peripheral wall 19 are provided with cutouts 19*a* which, in turn, cause legs 19*b* to be formed at these edges. The uppermost ones of the legs 19*b* are located adjacent the upper end wall 8 of the cooling jacket while the lowermost ones of the legs 19*b* are located adjacent the lower end wall 9 of the cooling jacket. The slots 19*a* permit coolant to flow from the exterior of the baffle 18 to the interior thereof, and vice versa.

The outer surface of the peripheral wall 19 is provided with an annular flange 21 which, as most clearly seen from FIG. 2 is located at the same level as, and abuts, the flange 6 on the inner surface of the cooling jacket. The flange 21 has a circular groove which faces the flange 6 and accommodates a seal 22.

The outer surface of the peripheral wall 19 is further provided with four sets of ribs. Each set includes a pair of ribs 23 which extend in longitudinal direction of the baffle 18 and are aligned in this direction. One of the ribs 23 of each pair is located above the flange 21 while the other is located below the flange 21. Each pair of ribs 23 forms an extension of a leg of the cruciform-like member 20 of the baffle 18. The upper surfaces of the uppermost ribs 23 are in the same plane as the upper surfaces of the cruciform-like member 20 and, similarly, the lower surfaces of the lowermost ribs 23 are in the same plane as the lower surface of the member 20. The outer surfaces of the ribs 23 are flush with the outer surface of the flange 21.

Each of the ribs 23 is aligned with and abuts one of the ribs 7 provided on the inner surface of the cooling jacket. A seal 24 is arranged between each set of ribs 7 and 23 and the seals 24 are accommodated in vertical grooves provded in the ribs 23 as best seen from FIG. 1.

Diametrical grooves are provided in the upper and lower surfaces of the cruciform-like member 20 of the baffle 18 and extend into the corresponding surfaces of the ribs 7 and 23. These grooves accommodate seals 25 which bear against the respective upper and lower end walls 8 and 9.

The flange 6 and ribs 7 on the inner surface of the cooling jacket cooperate with the flange 21 and ribs 23 on the outer surface of the baffle 18 to define four pairs of chambers in the space between the circumferential wall 4 of the cooling jacket and the peripheral wall 19 of the baffle 18. Each pair is associated with one of the compartments 18*a*–18*d* of the baffle 18 and includes a lower chamber 26*a* serving as an inlet chamber for the coolant and an upper chamber 26*b* serving as an outlet chamber for the coolant.

The circumferential wall 4 of the cooling jacket is provided with an inlet opening 27*a* for each inlet chamber 26*a* and an outlet opening 27*b* for each outlet chamber 26*b*. Correspondingly, the external flange 5 of the cooling jacket is provided with an inlet passage 28*a* for each inlet chamber 26*a* and an outlet passage 28*b* for each outlet chamber 26*b*. The inlet passages 28*a* communicate directly with the respective inlet openings 27*a*. On the other hand, the outlet passages 28*b* communicate with the respective outlet openings 27*b* via discharge spaces 29 located above the external flange 5. The discharge spaces 29 are formed by appropriately shaped sheets 30 which are secured to the circumferential wall 4 of the cooling jacket above the outlet openings 27*b* and extend to a location of the external flange 5 radially outwardly of the outlet passages 28*b*.

The inlet passages 28*a* have openings 31*a* which face the mold table 2. Similarly, the outlet passages 28*b* have openings 31*b* which face the mold table 2.

The mold table 2 has a location adjacent which a mold used for casting is positioned during a casting operation. At this location, the mold table 2 is provided with a pair of conduits 32*a* and 32*b*. The conduit 32*a* is connected with a source of coolant, typically water, and functions as an inlet for delivering coolant to the cooling jacket. On the other hand, the conduit 32*b* functions as an outlet for coolant which has circulated through the cooling jacket. The conduit 32*b* is connected with an appropriate discharge area or, in the event that the coolant is recirculated, with a purifying apparatus. The conduits 32*a* and 32*b* are arranged such that they can respectively register with the openings 31*a* and 31*b* of the particular pair of inlet and outlet passages 28*a* and 28*b* positioned at the casting location.

The mold table 2 has a pair of circular grooves in its upper surface at the casting location. These grooves surround the conduits 32*a* and 32*b* and accommodate seals 33.

The seals 22, 24 and 25 isolate the various pairs of inlet and outlet chambers 26*a* and 26*b*, as well as the various compartments 18*a*–18*d* of the baffle 18, from one another. Thus, coolant is prevented from flowing between different pairs of chambers 26*a* and 26*b* and between different ones of the compartments 18*a*–18*d*.

The seal 22 further prevents coolant entering an inlet chamber 26*a* from flowing directly upwardly into the associated outlet chamber 26*b*. The only communication between the inlet chamber 26*a* and its associated outlet chamber 26*b* is via the slots 19*a* in the baffle 18 and the one of the compartments 18*a*–18*d* corresponding to this pair of chambers 26*a* and 26*b*. This forces coolant entering an inlet chamber 26a to flow through the associated one of the compartments 18a–18d.

Four molds 34a, 34b, 34c and 34d are mounted in the cooling jacket. The molds 34a–34d have a generally vertical orientation and, as best seen in FIG. 1, each of the molds 34a–34d is accommodated in a respective one of the compartments 18a–18d of the baffle 18.

Each of the molds 34a–34d has a casting passage 34' which extends the length of the respective mold.

The molds 34a–34d, which may be straight or curved depending upon the continuous casting installation, are here in the form of tubes. In the steel industry, such molds are normally used to cast billets and blooms.

The molds 34a–34d may all have the same size or may have different sizes. Similarly, the molds 34a–34d may all have the same cross-sectional configuration or may have different cross-sectional configurations. The molds 34a–34d may also be tapered and, in such event, may all have the same taper or may have different tapers. The use of different tapers is particularly advantageous when various metals, e.g. different steel grades, having different shrinkage characteristics are being cast.

In order to permit the introduction of molten metal into the casting passages 34', the upper end wall 8 of the cooling jacket is provided with four openings 35 which respectively register with the four casting passages 34'. The mold cover guide 12 which, as indicted previously, is divided into four segments on that side thereof facing the end wall 8, has four openings 36. Each of the openings 36 is located in a different one of the segments and the latter respectively overlie different ones of the molds 34a–34d so that every opening 36 registers with an opening 35.

Similarly, in order that strands may issue from the casting passages 34', the lower end wall 9 of the cooling jacket is provided with four openings 37. The keeper plate 16 has corresponding openings 38.

The molds 34a–34d are centered in their respective positions with the aid of the end walls 8 and 9. Thus, the lower ends of the molds 34a–34d are closely received in the respective openings 37 provided in the lower end wall 9. On the other hand, the upper ends of the molds 34a–34d are closely received in bores provided in the regions of the respective openings 35 of the upper end wall 8.

Each of the molds 34a–34d has a pair of grooves in the region of the upper end thereof. The grooves are arranged in opposite walls of the respective molds 34a–34d and are parallel to one another. Each groove receives a key 39. The keys 39 are releasably secured to the upper end wall 8 by means of fasteners such as bolts 40 thereby supporting the molds 34a–34d in the cooling jacket.

The upper end wall 8 is provided with a circular cutout adjacent each of the molds 34a–34d. The respective keys 39 and molds 34a–34d cooperate to enclose the cutouts, and seals 41a are arranged in the spaces so formed.

Similarly, the lower end wall 9 has a circular cutout adjacent each of the molds 34a–34d. These cutouts, which are enclosed by the keeper plate 16 and the respective molds 34a–34d, accommodate seals 41b. The keeper plate 16 prevents the seals 41b from dropping out of the respective cutouts.

A gap 42 is provided between each of the molds 34a–34d and the walls of the associated compartment 18a–18d in order that coolant may flow around the molds 34a–34d. The direction of flow of the coolant is illustrated in FIG. 2 with reference to the mold 34a which is assumed to be in position for casting. The molds 34b–34d are assumed to be in standby positions.

Referring to FIG. 2, the mold 34a is accommodated in the compartment 18a of the baffle 18. The inlet and outlet passages 28a and 28b associated with the compartment 18a respectively register with the inlet and outlet conduits 32a and 32b in the mold table 2 as shown. As indicated by the arrows, the coolant flows through the inlet conduit 32a and the inlet passage 28a into the inlet chamber 26a for the compartment 18a. The coolant next passes through the lowermost slots 19a of the baffle 18 and enters the gap 42 between the mold 34a and the walls of the compartment 18a. After travelling upwardly in the gap 42, the coolant enters the outlet chamber 26b for the compartment 18a via the uppermost slots 19a of the baffle 18. The coolant leaves the outlet chamber 26b via the discharge space 29, the outlet passage 28b and the outlet conduit 32b.

As outlined earlier, the side of the mold cover guide 12 facing the upper end wall 8 is divided into four segments and a gap 14 exists between the guide 12 and the end wall 8 within each of these segments. The gaps 14 make it possible to introduce lubricant into the molds 34a–34d via conventional, non-illustrated lubrication passages which may be provided in the end wall 8.

The outer periphery of the external flange 5 of the cooling jacket is provided with teeth 43 which engage a gear mechanism 44 mounted on the mold table 2. The gear mechanism 44, which may be motor-driven or manually operated, makes it possible to rotate the cooling jacket on the mold table 2 about a vertical axis. In this manner, different ones of the molds 34a–34d may be brought into the casting position.

Clamping devices 45 are mounted on the mold table 2 to releasably clamp the cooling jacket in position. The clamping devices 45 are arranged to bear down on the outer periphery of the external flange 5 of the cooling jacket thereby pressing the flange 5 onto the mold table 2. The clamping devices 45 may, for example, be in the form of spring-loaded, quick-release hydraulic mechanisms.

In operation, the mold table 2 and hence the entire mold assembly 1, are reciprocated via the oscillator 3. A coolant, typically water, is circulated about the mold 34a in the casting position while molten steel is continuously admitted into the mold 34a to form a strand. When the mold 34a becomes worn, or when it is desired to change the dimensions and/or cross-sectional configuration of the strand being cast, or when a steel having different shrinkage characteristics is to be cast, the introduction of steel into the mold 34a is interrupted. The trailing end of the strand is withdrawn from the mold cavity 34' and the reciprocation of the mold assembly 1, as well as the flow of coolant, are stopped. Connections to the cooling jacket, such as connections for admitting lubricant into the mold 34a, are broken and the clamping devices 45 are released. The gear mechanism 44 is operated and the cooling jacket is rotated by 90° or a multiple thereof so that the desired one of the molds 34b–34d is brought into the casting position. The clamping devices 45 are once again set and the connections previously broken are re-established. In the event that a new strand is to be started, a dummy or starter bar head is inserted into the mold which is now in the casting position and is sealed therein. On the other hand, if the previous strand is to be continued, the trailing end of this strand is backed into the mold. The reciprocation of the mold assembly 1, as well as the flow of coolant, are restarted and molten steel is now introduced into the mold which has just been placed in the casting position.

It is possible to have the cooling jacket remain stationary while the molds 34*a*–34*d* move into and out of the casting position within the cooling jacket. In this case, the upper and lower end walls 8 and 9, as well as the mold cover guide 12 and the keeper plate 16, each need be provided with only one opening for casting. Also, only one set of passages for coolant need then be provided in the external flange 5 of the cooling jacket.

Moreover, in a simplified construction, the ribs 7 on the inner surface of the cooling jacket and the ribs 23 on the outer surface of the baffle 18 may be eliminated. However. since the various pairs of inlet and outlet chambers 26*a* and 26*b* will then be in fluid communication, the quantities of coolant required will increase. In addition, seals equivalent to the seals 33 may then be required at the standby locations of the molds 34*a*–34*d* in order to prevent the escape of coolant at these locations.

Figure 4:
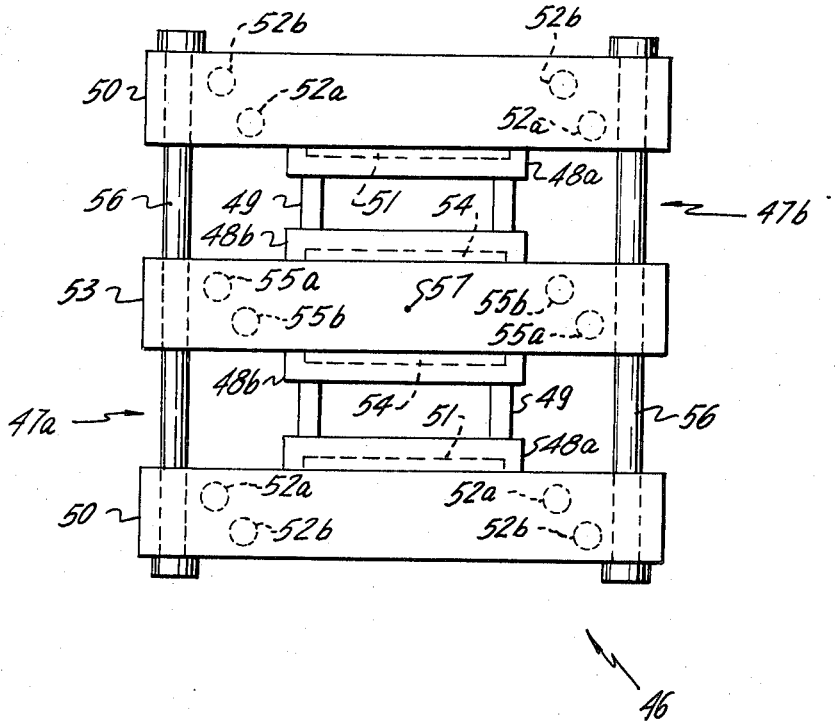
FIG. 4 is a plan view of another embodiment of a mold assembly in accordance with the invention.

FIG. 4 shows an embodiment of the invention suited for plate molds, that is, molds of the type made up of separate, thermally conductive plates, typically copper plates, which are secured to back-up plates. Since such molds, which are used for the casing of blooms and slabs, are well-known, only those details necessary for an understanding of the invention have been illustrated.

The mold assembly of FIG. 4 is generally identified by the reference numeral 46 and rests on a non-illustrated mold table which, as before, is mounted for reciprocation. The mold assembly 46 includes two plate molds 47*a* and 47*b* which may have the same size and taper or may have different sizes and/or tapers. Each of the plate molds 47*a* and 47*b* has a pair of wide walls 48*a* and 48*b* as well as a pair of narrow walls 49 which are clamped between the wide walls 48*a* and 48*b*.

The wide walls 48*a* are mounted on back-up plates 50. Those faces of the wide walls 48*a* which abut the back-up plates 50 are formed with channels which are open to the back-up plates 50. The latter cooperate with the wide walls 48*a* and the channels therein to define cooling passages 51 for the wide walls 48*a*.

The back-up plates 50 are provided with internal coolant inlet and outlet conduits which lead to the cooling passages 51. Each back-up plate 50 has a pair of coolant inlet and outlet openings 52*a* and 52*b* on either side thereof which are adapted to register with corresponding openings in the mold table when the associated mold 47*a* or 47*b* is in the casting position. Coolant enters the inlet openings 52*a* and is directed through the conduits in the back-up plates 50 to the cooling passages 51. After passing through the cooling passages 51, the coolant is discharged via the outlet openings 52*b*. Provision is made for coolant to enter and leave the back-up plates 50 on both sides thereof since the back-up plates 50 are here relatively wide and the cooling effect might otherwise be insufficient.

According to the invention, the wide walls 48*b* of the two plate molds 47*a* and 47*b* are mounted on a common back-up plate 53. Those faces of the wide walls 48*b* adjacent the back-up plate 53 are formed with channels which are open to the back-up plate 53. The latter cooperates with the two wide walls 48*b*, as well as the channels therein, to define cooling passages 54 for the wide walls 48*b*.

The back-up plate 53 has internal coolant inlet and outlet conduits which lead to the cooling passages 54. A pair of coolant inlet and outlet openings 55*a* and 55*b* is provided on either side of the back-up plate 53. The openings 55*a* and 55*b* are adapted to register with corresponding openings in the mold table whenever either one of the molds 47*a* or 47*b* is in the casting position. Each of the openings 55*a* and 55*b* communicates with the cooling passages 54 of both wide walls 48*b*. Consequently, coolant always flows to each of the wide walls 48*b* regardless of which of the molds 47*a* and 47*b* is in the casting position.

Instead of one pair of openings 55*a* and 55*b* on either side of the back-up plate 53, it is possible to provide two pairs of coolant inlet and outlet openings on either side of the back-up plate 53. Here, one pair of openings on either side will be associated with the cooling passages 54 of the mold 47*a* while the other pair on either side will be associated with the cooling passages 54 of the mold 47*b*. The two pairs of openings for the mold 47*a* will be adapted to register with corresponding pairs of openings in the mold table when the mold 47*a* is in the casting position and the same applies for the two pairs of openings for the mold 47*b*.

The narrow walls 49 of the molds 47*a* and 47*b* are secured to non-illustrated back-up plates which are connected with spindles for moving the narrow walls 49 back-and-forth in order to effect changes in the width being cast. The details of the mounting of the narrow walls 49, as well as the manner of cooling the latter, are well-known and have thus been omitted here.

The mold assembly 46 has bolts 56 on either side thereof. These hold the assembly 46 together and cause the narrow walls 49 to be clamped between the wide walls 48*a* and 48*b*. The design is such that the clamping force on the walls 49 may be released so as to permit the movement thereof necessary to effect a change in width. Since the details involved are conventional, these have not been illustrated.

The mold assembly 46 is rotatable on the mold table about a vertical axis 57. Assuming that the mold 47*a* is in the casting position, rotation of the mold assembly 46 by 180° to either the right or the left then permits the mold 46*b* to be quickly brought into the casting position. The mold assembly 46 may be mounted for rotation in any suitable manner. For example, the mold assembly 46 may be positioned on a vertical, rotatable shaft which lies on the axis 57.

The mold assembly 46 may be releasably clamped on the mold table in position for casting using any suitable clamping mechanism. Also, it will be understood that appropriate seals are provided where necessary to prevent leakage of coolant.

Various modifications may be made within the scope of the invention. For example, instead of mounting a mold assembly in accordance with the invention for sliding movement on the mold table, it is possible to hoist the mold assembly slightly, e.g. by means of a crane, and rotate the mold assembly while it is suspended. Another possibility is to provide a retractable roller bearing of annular configuration on the mold table and to have the mold assembly ride on the roller bearing during rotation.

Moreover, it is possible to arrange a mold assembly according to the invention such that a fresh mold is brought into the casting position by linear displacement rather than by rotation.

It will also be understood that the number of molds incorporated in a mold assembly of the invention may be different from what has been illustrated.

We claim:

1. A continuous casting installation comprising:
(a) a mold assembly having a plurality of open-ended molds, said mold assembly being arranged so that one of said molds is in a casting position and another of said molds is in a standby position, and said mold assembly including a member which is commohn to all of said molds and cooperates with each of said molds to define a mold cooling passage therewith, said molds being movable to and from said casting position while cooperating with said member to define said cooling passages thereby permitting rapid substitution of one mold for another;
(b) a support for said mold assembly;
(c) means for supplying coolant to and discharging coolant from said cooling passages; and
(d) means for moving said molds to and from said casting position.

2. An installation as defined in claim 1, wherein said molds have different sizes.

3. An installation as defined in claim 1, wherein said molds have different cross-sectional configurations.

4. An installation as defined in claim 1, wherein said molds are differently tapered so as to permit casting of different compositions.

5. An installation as defined in claim 1, wherein said member carries at least a portion of each of said molds.

6. An installation as defined in claim 1, wherein said molds are arranged to move in unison.

7. An installation as defined in claim 1, wherein said mold assembly is rotatable so that said molds move to and from said casting position along a circular path.

8. An installation as defined in claim 1, wherein said support comprises means for reciprocating said mold assembly.

9. An installation as defined in claim 1, comprising releasable clamping means to hold said mold assembly in position on said support.

10. An installation as defined in claim 1, said supplying and discharging means comprising an inlet and an outlet conduit in said support, and said member including coolant inlet means and coolant outlet means for each of said molds; and wherein said inlet and outlet means are arranged to respectively register with said inlet and outlet conduits when the corresponding mold is in said casting position.

11. An installation as defined in claim 1, wherein each of said molds comprises a plurality of individual, thermally conductive plates and said member includes a back-up plate which supports a thermally conductive plate of each of said molds.

12. An installation as defined in claim 1, wherein said molds are in the form of tubes and said member includes a cooling jacket which surrounds said molds.

13. An installation as defined in claim 12, comprising baffle means in said cooling jacket to direct the flow of coolant about the respective molds, said baffle means subdividing the interior of said cooling jacket into a plurality of compartments, and each of said molds being located in a different one of said compartments.

14. An installation as defined in claim 13, wherein said supplying and discharging means includes an inlet and an outlet conduit in said support, and said cooling jacket includes coolant inlet means and coolant outlet means for each of said compartments, said inlet and outlet means being arranged so as to respectively be in alignment with said inlet and outlet conduits when the corresponding mold is in said casting position.

15. An installation as defined in claim 14, comprising sealing meams for preventing fluid communication between said compartments.

16. A continuous casting method comprising the steps of:
(a) forming a continuously cast strand by continuously introducing molten metal into one of a plurality of open-ended molds having a common member which cooperates with each of said molds to define a cooling passage therewith, said one mold being positioned at a casting location;
(b) cooling said one mold during the forming step by supplying coolant to the respective cooling passage;
(c) terminating the introduction of molten metal into said one mold;
(d) withdrawing the trailing end of said strand from said one mold;
(e) moving said one mold away from said casting location while continuing to define said cooling passages by cooperation between said molds and said member;
(f) moving another of said molds to said casting location while continuing to define said cooling passages by cooperation between said molds and said member;
(g) continuously admitting molten metal into said other mold; and
(h) cooling said other mold during the admitting step by supplying coolant to the respective cooling passage.

17. A method as defined in claim 16, wherein said one and other molds are moved along a circular path.

18. A method as defined in claim 16, wherein said one and other molds are moved in unison.

19. A method as defined in claim 16, said molds being supported by said member; and wherein the steps of moving said one and other molds comprise moving said member while maintaining said one and other molds stationary relative to said member.

20. A continuous casting installation comprising:
(a) a mold assembly having a plurality of open-ended molds in the form of tubes, said mold assembly including a cooling jacket which is common to and surrounds all of said molds and cooperates with each of said molds to define a cooling passage therewith, and said molds being supported by said cooling jacket, said cooling jacket being driven so as to move said molds to and from a common casting position while said molds cooperate with said cooling jacket to define said cooling passages thereby permitting rapid substitution of one mold for another;
(b) a support for said mold assembly;
(c) means for suppyling coolant to and discharging coolant from said cooling passages; and
(d) means for moving said molds to and from said casting position, said moving means including an external flange on said cooling jacket having a toothed periphery and a driven gear cooperating with the teeth on said flange.

* * * * *